US005221213A

United States Patent [19]

Lee

[11] Patent Number: 5,221,213

[45] Date of Patent: Jun. 22, 1993

[54] HIGH TENSION CABLE TERMINAL ASSEMBLY FOR IGNITION DISTRIBUTORS

[76] Inventor: Hsi C. Lee, No. 35, Lane 36, Shih Chien Road, Changhua, Taiwan

[21] Appl. No.: 917,759

[22] Filed: Jul. 21, 1992

[51] Int. Cl.[5] ..... H01R 11/26

[52] U.S. Cl. ..... 439/125; 439/34

[58] Field of Search ..... 439/125-128, 439/130, 34, 502

*Primary Examiner*—Gary F. Paumen

*Attorney, Agent, or Firm*—Thomas R. Vigil

[57] ABSTRACT

A high tension cable terminal assembly which is consisted of an internally threaded socket terminal fastened to a high tension cable of a motor vehicle's ignition system for connection to a terminal on the cap of a motor vehicle's ignition distributor directly or by means of a cylindrical socket adapter terminal or dihedral wing adapter terminal according to the type of the terminal on the cap of the ignition distributor to be connected. A pin hole is made on the cylindrical socket adapter terminal as well as the dihedral wing adapter terminal for inserting a lock pin to provide added connection. The internally threaded socket terminal may be made from an angle metal for connecting a high tension cable to a terminal on the cap of a motor vehicle's ignition distributor at right angle.

7 Claims, 3 Drawing Sheets

HIGH TENSION CABLE TERMINAL ASSEMBLY FOR IGNITION DISTRIBUTORS

BACKGROUND OF THE INVENTION

1. Field of Invention

The present invention relates to high tension cable terminals and relates more particularly to a high tension cable terminal assembly which can be conveniently adjusted according to the type of ignition distributor to be connected thereto.

2. Description of Prior Art

The engine assembly of a motor vehicle generally includes multiple cylinders separately connected to an ignition system through an ignition distributor. In a motor vehicle, high tension cables are connected between the ignition distributor and the engine assembly for transmitting electric power to respective spark plugs. Therefore, the cap of a motor vehicle's ignition distributor has connecting means for connecting the terminals of the high tension cables from the ignition system. The tightness of connection of the terminals of the high tension cables of a motor vehicle's ignition system to the cap of the motor vehicle's ignition distributor greatly affects the performance of the motor vehicle's engine assembly. Because different models of motor vehicles use different structures of ignition distributors, different terminals are provided for connecting high tension cables to different ignition distributors. FIG. 1 illustrates a terminal for connecting a high tension cable to the cap of an ignition distributor which is commonly used in Japanese cars such as Toyota and Mazda series. This structure of a terminal has a C-shaped cross section on the bottom which contacts a respective conducting strip inside the cap when inserted into a connecting stub tube on the cap. This structure of a terminal is easy to connect to an ignition distributor, however, it can not eliminate the problem of elastic fatigue which tends to happen more particularly after a long use. FIG. 2 illustrates another structure of a terminal which is commonly used in European cars such as Volvo, BMW, and Volkswagen series. This structure of a terminal has an annular groove adjacent to the bottom edge thereof onto which a C-shaped retainer is mounted to secure the terminal inside a connecting stub tube on the cap of an ignition distributor. FIG. 3 illustrates still another structure of a terminal which is commonly used in Renault 21 and 11 and Mercury Sable car. This structure of terminal is designed for connecting to either connecting terminal on the outside of the cap of an ignition distributor at a right angle. FIG. 4 illustrates two different structures of terminals which are used in connecting high tension cables to a common ignition distributor of a Chrysler car. These two structures of terminals include one having a flat, hooked plug strip and the other having a socket. By inserting the split plug strip or the socket into a respective stub tube on the cap of an ignition distributor, a respective high tension cable is electrically connected to the ignition distributor.

As indicated, different structures of terminals may be used for different types of ignition distributors. Because these structures of terminals are not interchangeable, a material supplier or car repair shop may have to provide a variety of terminals for sale or repair. This disadvantage causes difficulties to a car owner in repairing a damaged terminal by oneself.

SUMMARY OF THE INVENTION

The present invention eliminates the aforesaid problems. It is therefore the main object of the present invention to provide a high tension cable terminal assembly which can be alternatively arranged into any of a variety of forms for connecting a high tension cable to a terminal on the cap of a motor vehicle's ignition distributor according to the type of the terminal on the cap of the motor vehicle's ignition distributor to be connected.

According to one aspect of the present invention, a high tension cable terminal assembly is generally comprised of an internally threaded socket terminal fastened to a high tension cable of a motor vehicle's ignition system which has a bolt hole opening for connecting to a terminal on the cap of a motor vehicle's ignition distributor directly or by means of an adapter terminal, a cylindrical socket adapter terminal which has a screw rod on one end fitted into the bolt hole opening on the internally threaded socket terminal and an internally threaded extension rod on an opposite end with a clamp mounted on an annular groove around the outside wall thereof, and a dihedral wing adapter terminal which has a screw rod on one end fitted into the bolt hole opening on the internally threaded socket terminal and a dihedral wing socket on an opposite end for connection to a terminal on the socket of a motor vehicle's ignition distributor.

According to another aspect of the present invention, the cylindrical socket adapter terminal has a pin hole on the outside communicated with the bolt hole opening on the internally threaded extension rod for inserting a lock pin in locking the cylindrical socket adapter terminal to the dihedral wing adapter terminal or a terminal on the cap of a motor vehicle's ignition distributor.

According to still another aspect of the present invention, the dihedral wing adapter terminal has a pin hole on the outside for inserting a lock to lock the dihedral wing socket in place.

According to still another aspect of the present invention, the dihedral wing adapter terminal has a screw rod on an extension rod above the dihedral wing socket for fastening the internally threaded socket terminal directly.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 4:
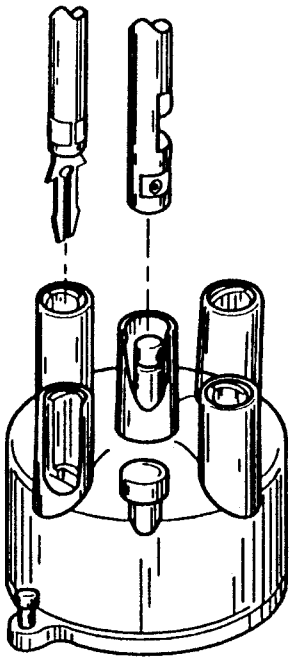
FIG. 4 PRIOR ART
FIG. 4 illustrates still another two prior art high tension cable terminals used in connecting high tension cables to different terminals on the cap of an ignition distributor which is used in a Chrysler car.
Figure 3:
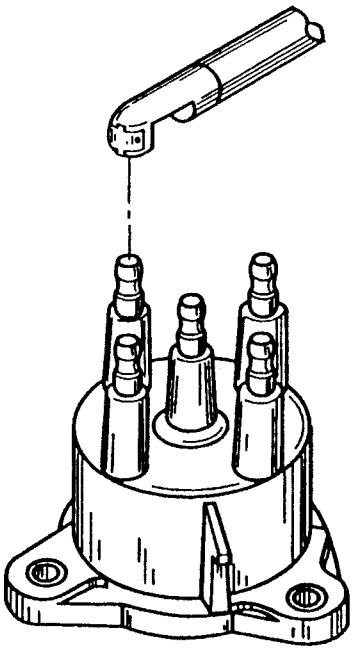
FIG. 3 PRIOR ART
FIG. 3 illustrates still another prior art high tension cable terminal used in connecting a high tension cable to a terminal on the cap of an ignition distributor which is used in a Renault or Mercury Sable car.
Figure 2:
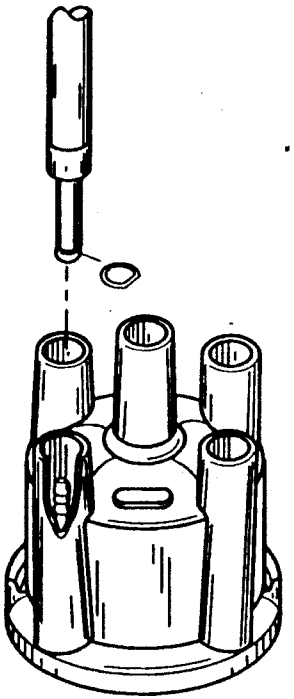
FIG. 2 PRIOR ART
FIG. 2 illustrates another prior art high tension cable terminal used in connecting a high tension cable to a terminal on the cap of an ignition distributor which is used in a Volvo, BMW or Volkswagen car.
Figure 1:
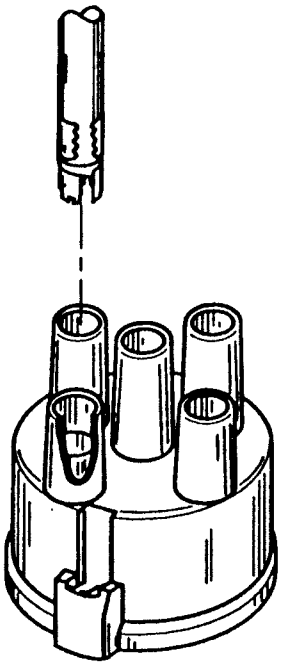
FIG. 1 PRIOR ART
FIG. 1 illustrates a prior art high tension cable terminal used in connecting a high tension cable to a terminal on the cap of an ignition distributor which is used in a Japanese car.
Figures 5, 5A, 5B, 5C, 10:
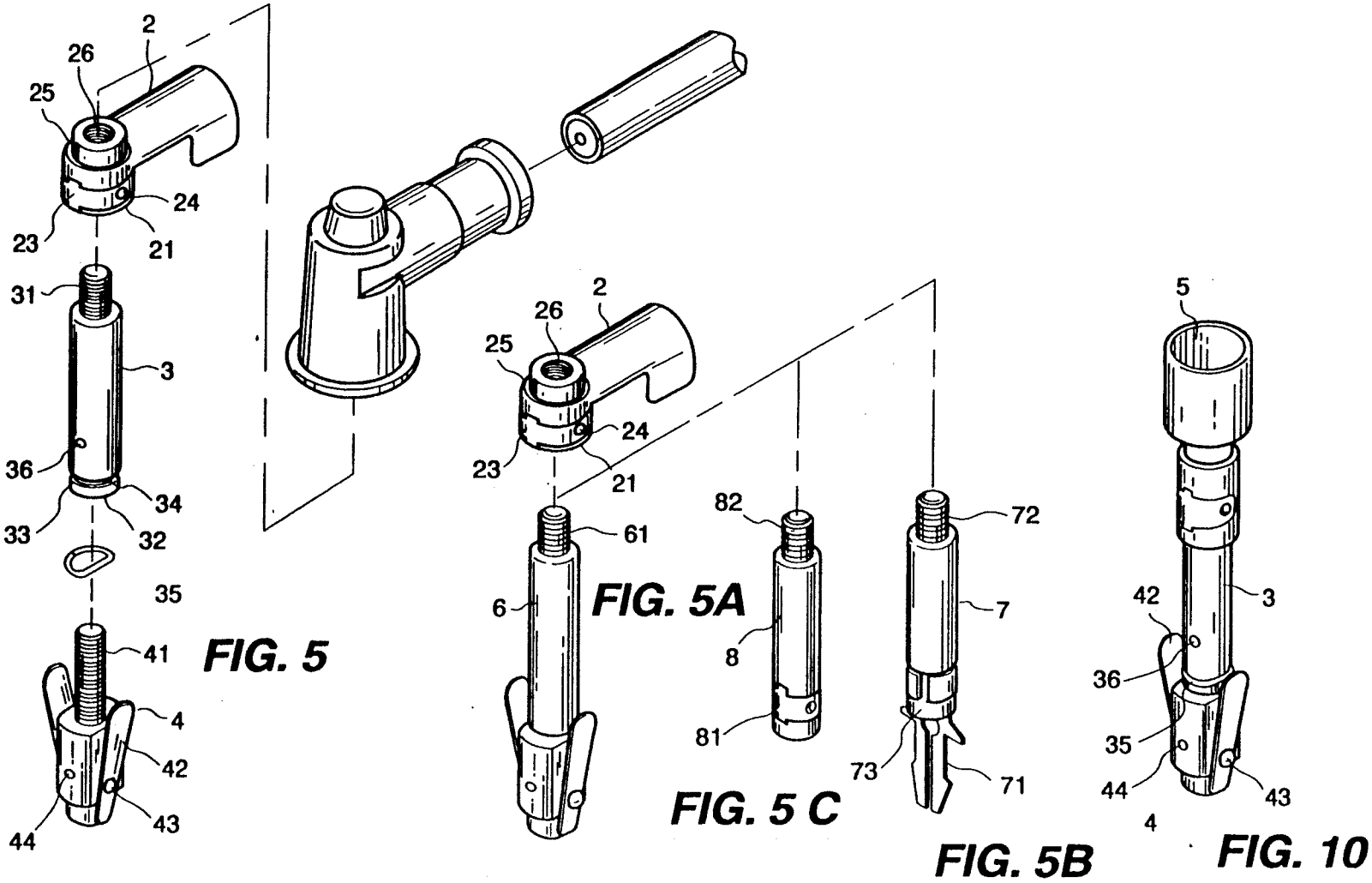
FIG. 5 is an exploded view of the high tension cable assembly of the present invention.
FIG. 5A illustrates an alternate form of the dihedral wind adapter terminal according to the present invention.
FIG. 5B illustrates an alternate form of the cylindrical socket adapter terminal according to the present invention and shows a flat, hooked plug strip attached thereto.
FIG. 5C illustrates another alternate form of the cylindrical socket adapter terminal according to the present invention and shows a round socket is attached thereto.
FIG. 10 illustrates a straight socket terminal for replacing the angle socket terminal.
Figure 9:
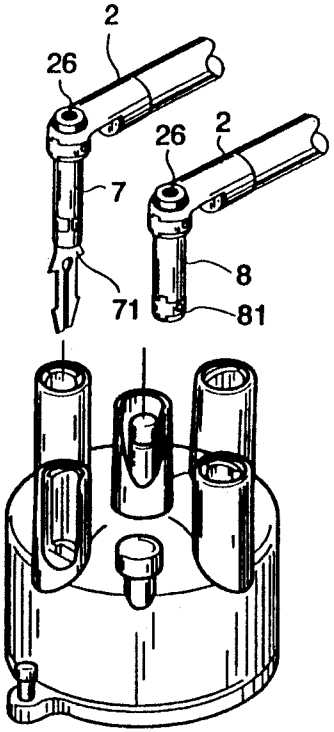
FIG. 9 illustrates the connecting of the adapter terminals of FIGS. 5B and 5C to angle socket terminals for connecting high tension cables to different terminals on the cap of an ignition distributor which is used in a Chrysler car.

Referring to FIG. 5, the present invention includes an angle socket terminal 2, a cylindrical socket adapter terminal 3, and a dihedral wing adapter terminals 4. The angle socket terminal 2 is made from an angle metal plate having a front socket 21, a retainer ring 23 fastened around the front socket 21, which has two raised portions 24 on the outside at two opposite locations, an internally threaded tube 26 fastened in a longitudinal through hole 25 on the front socket 21 through a rivet joint. The cylindrical socket adapter terminal 3 is made from a cylindrical rod having a screw rod 31 on one end, an internally threaded extension rod 32 on an opposite end, and a pivot hole 36 through the body thereof in radial direction. The screw rod 31 and the internally threaded extension rod 32 each have an outer diameter relatively smaller than the outer diameter of the body of the cylindrical socket terminal 3. The internally threaded extension rod 32 has an annular groove 33 around the outside surface thereof and a hole 34 on the annular groove 33 for fastening a clamp 35 around the annular groove 33. The dihedral wing adapter terminal 4 has a screw rod 41 on one end, a dihedral wing socket 42 on an opposite end, a hole 44 through the body thereof in radial direction, and two raised portions 43 on the dihedral wing socket 42 on the outside at two opposite locations.

Figure 6:
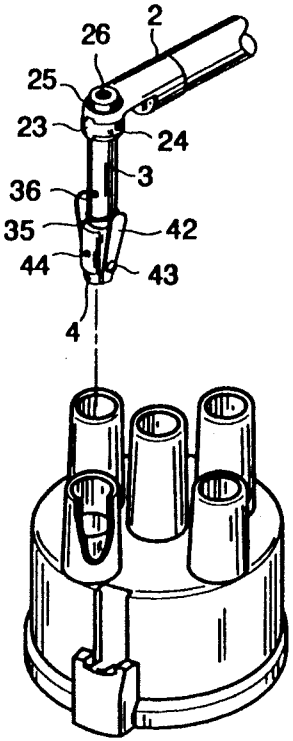
FIG. 6 illustrates an arrangement according to the present invention showing the angle socket terminal, the cylindrical socket adapter terminal and the dihedral wing adapter terminal connected into a terminal assembly for connecting a high tension cable to a terminal on the cap of an ignition distributor which is used in a Japanese car.

Referring to FIG. 6, by threading the screw rod 41 of the dihedral wing adapter terminal 4 into the internally threaded extension rod 32 on the cylindrical socket adapter terminal 3 and the screw rod 31 of the cylindrical socket adapter terminal 3 into the internally threaded tube 26 on the angle socket terminal 2, the angle socket terminal 2, the cylindrical socket adapter terminal 3 and the dihedral wing adapter terminal 4 are connected into a terminal assembly suitable for connecting a high tension cable to the cap of an ignition distributor used in a Toyota or Mazda car. When connected, a pin (not shown) may be inserted into the pivot hole 36 on the cylindrical socket terminal to lock the screw rod 41 of the dihedral wing adapter terminal 4 in place. After inserted into a port on the cap of an ignition distributor, the terminal assembly is secured in place by means of the effect of the raised portions 43 on the dihedral wing 42. Furthermore, a lock pin (not shown) may be inserted into the hole 44 to provide added connection.

Figure 7:
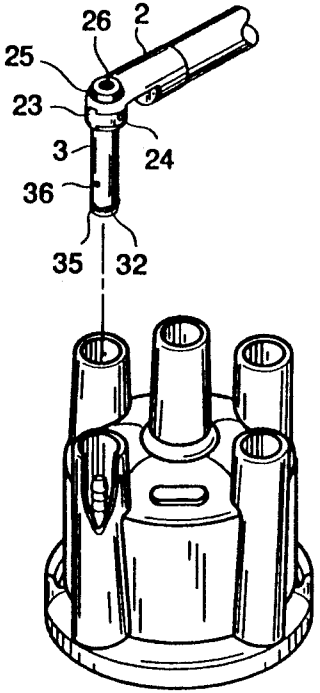
FIG. 7 illustrates another arrangement according to the present invention showing the angle socket terminal and the cylindrical socket adapter terminal connected into a terminal assembly for connecting a high tension cable to a terminal on the cap of an ignition distributor which is used in a Volvo, BMW or Volkswagen car.

Referring to FIG. 7, by threading the screw rod 31 of the cylindrical socket adapter terminal 3 into the internally threaded tube 26 on the angle socket terminal 2, the angle socket terminal 2 and the cylindrical socket adapter terminal 3 are connected into a terminal assembly suitable for connecting a high tension cable to the cap of an ignition distributor used in a Volvo, BMW, or Volkswagen car. When inserted into a port on the cap of an ignition distributor, the terminal assembly is secured in place by means of the effect of the clamp 35. A lock pin (not shown) may also be inserted into the pivot hole 36 to provide added connection.

Figure 8:
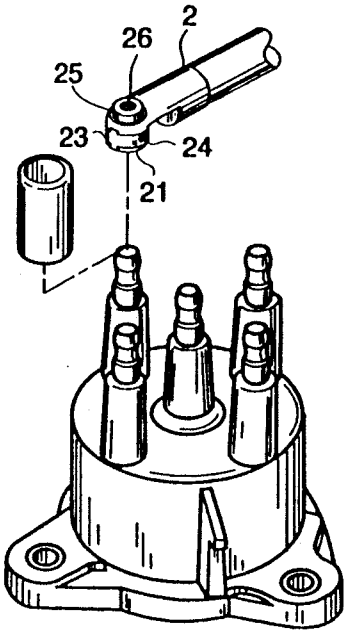
FIG. 8 illustrates the connecting of the angle socket terminal at the end of a high tension cable to a terminal on the cap of an ignition distributor which is used in a Renault or Mercury Sable car.

Referring to FIG. 8, the angle socket terminal 2 may be directly used in connecting a high tension cable to any terminal on the cap of an ignition distributor which is used in a Renault or Mercury Sable car.

Referring to FIG. 5A, there is illustrated therein an alternate form of the dihedral wing adapter terminal. In this alternate form, the dihedral wing adapter terminal 6 has a screw rod 61 on an extended cylindrical body thereof, and therefore it can be directly fastened to the angle socket terminal 2 for connecting a high tension cable to a terminal inside a port on the cap of an ignition distributor which is used in a Toyota or Mazda car.

Referring to FIGS. 5C and 5B, there is illustrated therein two alternate forms of the cylindrical socket adapter terminal. In FIG. 5C, the cylindrical socket adapter terminal 8 has a screw rod 82 on one end, which is to be threaded into the internally threaded tube 26 on the angle socket terminal 2, and a round socket 81 on an opposite end. In FIG. 5B, the cylindrical socket adapter 7 has a screw rod 72 on one end, which is to be threaded into the internally threaded tube 26 on the angle socket terminal 2, and a socket 73 on an opposite end fastened with a flat, hooked plug strip 71. These two types of cylindrical socket adapters are to be used commonly for connecting respective high tension cables to respective terminals on the cap of an ignition distributor which is used in a Chrysler car.

Referring to FIG. 10, a straight socket terminal 5 may be used instead of the angle socket terminal 2 in FIG. 5 for connecting a high tension cable to a terminal on the cap of an ignition distributor into a straight line. Similar to the angle socket terminal of FIG. 5, the straight socket terminal 5 has an internally threaded hole (not shown) on the inside into which the screw rod 31 on the cylindrical socket adapter terminal 3 fits. When connected, as shown in FIG. 10, the straight socket terminal 5, the cylindrical socket adapter terminal 3 and the dihedral wing adapter terminal 4 are longitudinally aligned.

As indicated, the present invention is to provide a high tension cable terminal assembly which can be conveniently adjusted according to the terminal on the cap of an ignition distributor to be connected.

I claim:

1. A high tension cable terminal assembly comprising:

an internally threaded socket terminal fastened to a high tension cable of a motor vehicle's ignition system, said internally threaded socket terminal having a bolt hole for connecting to a terminal on the cap of a motor vehicle's ignition distributor directly or by means of an adapter terminal;

a cylindrical socket adapter terminal having a screw rod on one end, which can be threaded into the bolt hole on said internally threaded socket terminal, an internally threaded extension rod on an opposite end, said internally threaded extension rod having a bolt hole opening in a bottom edge thereof and an annular groove around the outside surface thereof fastened with a clamp for positioning; and a dihedral wing adapter terminal having a screw rod on one end, which can be threaded into the bolt hole opening on said internally threaded socket terminal, and a dihedral wing socket on an opposite end.

2. The high tension cable terminal assembly according to claim 1, wherein said internally threaded socket terminal is made from an angle plate having a bolt hole opening at a right angle to the cable for connecting to a terminal on the cap of a motor vehicle's ignition distributor directly or by means of an adapter terminal.

3. The high tension cable terminal assembly according to claim 1, wherein said cylindrical socket adapter terminal further comprises a pin hole on the outside communicating with the bolt hole opening on said internally threaded extension rod for inserting a lock pin to lock said cylindrical socket adapter terminal to a terminal on the cap of a motor vehicle's ignition distributor; said dihedral wing adapter terminal further comprises a pin hole on said dihedral wing socket for inserting a lock pin to lock said dihedral wing socket to a terminal on the cap of a motor vehicle's ignition distributor.

4. The high tension cable terminal assembly according to claim 1 or to claim 2 wherein said dihedral wing socket of said dihedral wing adapter terminal has two raised portions on two opposite wings thereof for positioning in a port on the cap of a motor vehicle's ignition distributor.

5. The high tension cable terminal assembly according to claim 1 or to claim 2, wherein said dihedral wing adapter terminal has a screw rod on an extension rod above said dihedral wing socket for threading into the bolt hole opening on said internally threaded socket terminal.

6. The high tension cable terminal assembly according to claim 1 or to claim 2, wherein the internally threaded extension rod of said cylindrical socket adapter terminal is attached to a round socket for connecting to a round head terminal on the cap of a motor vehicle's ignition distributor.

7. The high tension cable terminal assembly according to claim 1 or to claim 2 wherein the internally threaded extension rod of said cylindrical socket adapter terminal is attached with a socket to hold a flat, hooked plug strip for connecting to a terminal port on the cap of a motor vehicle's ignition distributor.

* * * * *